United States Patent [19]

Hartmann et al.

[11] 4,399,680

[45] Aug. 23, 1983

[54] UNIVERSAL ROLLING MILL

[75] Inventors: Hans-Heinrich Hartmann, Meerbusch; Alexandr Svagr, Hilden, both of Fed. Rep. of Germany

[73] Assignee: SMS Schloemann-Siemag Aktiengesellschaft, Dusseldorf, Fed. Rep. of Germany

[21] Appl. No.: 283,425

[22] Filed: Jul. 15, 1981

[30] Foreign Application Priority Data

Oct. 17, 1980 [DE] Fed. Rep. of Germany ..... 3039203

[51] Int. Cl.[3] ..... B21B 31/14; B21B 13/10

[52] U.S. Cl. ..... 72/225; 72/238; 72/248

[58] Field of Search ..... 72/225, 237, 238, 239, 72/248, 481

[56] References Cited

U.S. PATENT DOCUMENTS 3,802,242 4/1974 Svagr ..... 72/238
3,908,426 9/1975 Aramaki ..... 72/238

FOREIGN PATENT DOCUMENTS 384010 10/1923 Fed. Rep. of Germany
413914 5/1925 Fed. Rep. of Germany .
933329 9/1955 Fed. Rep. of Germany .

*Primary Examiner*—Francis S. Husar
*Assistant Examiner*—Jonathan L. Scherer
*Attorney, Agent, or Firm*—Clifford A. Poff; Thomas H. Murray

[57] ABSTRACT

A pair of upper crossheads for a universal rolling mill is engaged with nut assemblies on extended ends of a pair of screwdown spindles. Each crosshead can be swung about a nut assembly on one of the screwdown spindles while disengaged from a nut assembly on the other screwdown spindle for pivotal movement of the crosshead to one side of the housing frame. The nut assemblies for the ends of the crossheads, which remain engaged with the screwdown spindles, have threads that raise the crossheads during pivotal movement. Pedestal supports on projecting wing portions of the frame carry the pivoted parts of the crossheads. During operation of the universal rolling mill, the upper crossheads are held in their operative position by a clamp engaged with a crosstie that extends between two nut assemblies that can be exposed.

7 Claims, 2 Drawing Figures

UNIVERSAL ROLLING MILL

BACKGROUND OF THE INVENTION

Figure 1:
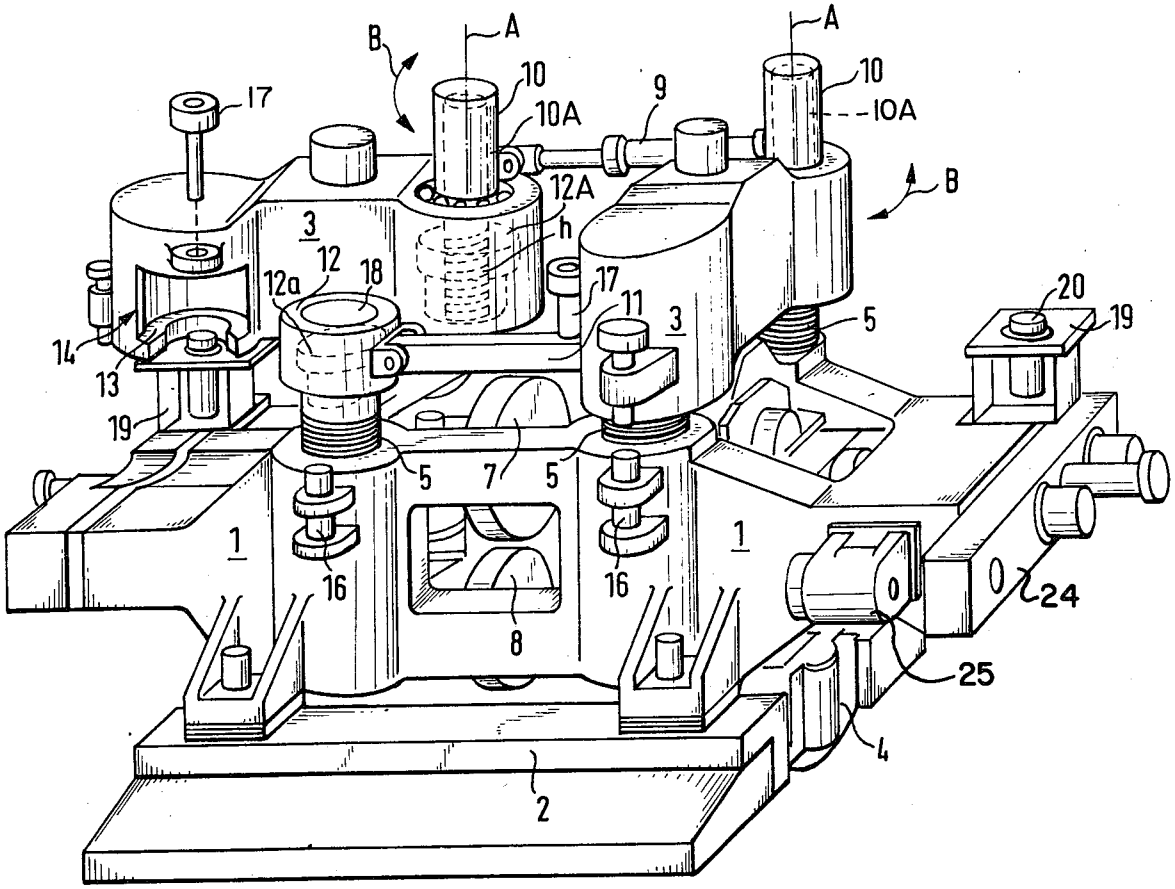

This invention relates to a universal rolling mill having horizontal and vertical rolls supported by bearing chocks received in windows of a frame that includes yoke sections with adjusting members for the vertical rolls. Upper and lower pairs of crossheads are connected by nut assemblies to screwdown spindles to adjustably position the horizontal rolls. The spindles are retained against axial movement but rotatably supported by the frame. Each of the upper crossheads is constructed to swing while supported at one end by a spindle engaged with a nut assembly, thereby exposing the top portion of the frame for removal and replacement of the roll assemblies.

It is known in the art, as shown in West German Pat. Nos. 38010 and 413 914, to construct a rolling mill so that it is possible to remove an upper crosshead used to close the top of a roll housing in order to replace an exchange frame. West German Pat. No. 933 329 discloses broad-face gear units which can be swung out of the rolling line about a central axis of rotation.

U.S. Pat. No. 3,802,242 discloses a universal rolling mill stand having two upper crossheads, each connected by a pair of screwdown tie rods to one pair of bottom crossheads. The crossheads are moved toward and away from a mill frame while contacting the bearing chocks of the horizontal rolls to adjust the roll gap. The screwdown tie rods are retained by the mill frame against axial movement while interconnected with the crossheads by nut members. Outwardly-extending wing portions at each side of the mill frame carry roll-adjusting spindles to position vertical roll assemblies of the universal rolling mill.

Such a mill stand construction is compact and offers the capability of processing a wide range of structural products through scheduled roll changes. However, to replace worn rolls, it is necessary to either replace the mill stand in the processing line with a substitute mill stand or change the rolls in the mill stand while located in the processing line. In either event, lubrication and other supply lines must be disconnected and the crossheads at the top of the mill stand must be raised vertically and removed from the spindles to permit removal of the roll assemblies. After replacement roll assemblies are installed in the mill stand, two nut members in each upper crosshead must be reengaged with the threaded ends of the screwdown tie rods. This operation requires accurate handling of the crossheads while carried by a crane. The present invention is designed to eliminate such handling of the crossheads and enhances the entire rolling operation.

SUMMARY OF THE INVENTION

It is an object of the present invention to construct and arrange upper crossheads for swinging movement on screwdown spindles to permit removal of roll assemblies from a universal rolling mill stand through the top thereof in such a way as to dispense with lifting devices for raising the crossheads and protect the top portions of the spindles against contamination.

According to the present invention, two upper crossheads are constructed for swinging sideways with respect to the passline about screwdown spindles supported for rotation and held against axial movement by a housing frame, the swivel axes of the crossheads extending along the screwdown spindles which are connected to the crossheads by way of nut assemblies, one nut assembly for each crosshead including a pivot bushing and a nut member engaged by threaded connection with a screwdown spindle such that the crosshead is lifted during swinging movement on the spindle, while the two remaining nut assemblies for the crossheads are connected together by way of a crosstie.

In the preferred form of the present invention, contact surfaces are provided on the swiveling parts of the crossheads to engage with nut assemblies mounted on the upper portions of the screwdown spindles. Piston and cylinder assemblies are hinged to the crossheads to carry out the swinging movement thereof. The crossheads are fixed by locked latch pins to the crosstie during operation of the rolling mill. A nut housing, forming part of the nut assembly, includes a cover to enclose the upper part of the screwdown spindle which is released from the crosshead. Supports, which can be hydraulically lifted and lowered, carry the crossheads when swung outwardly from the passline of the mill.

Such a rolling mill construction offers the advantage that, on one hand, the time to change rolls of the mill is reduced; and on the other hand, the screwdown spindles are permanently protected from contamination by foreign matter and possible damage during the actual roll-changing operation. The upper portions of the screwdown spindles are fully shielded from detrimental outside influences. Moreover, an expensive lifting tackle is no longer required for handling the crossheads.

Figure 2:
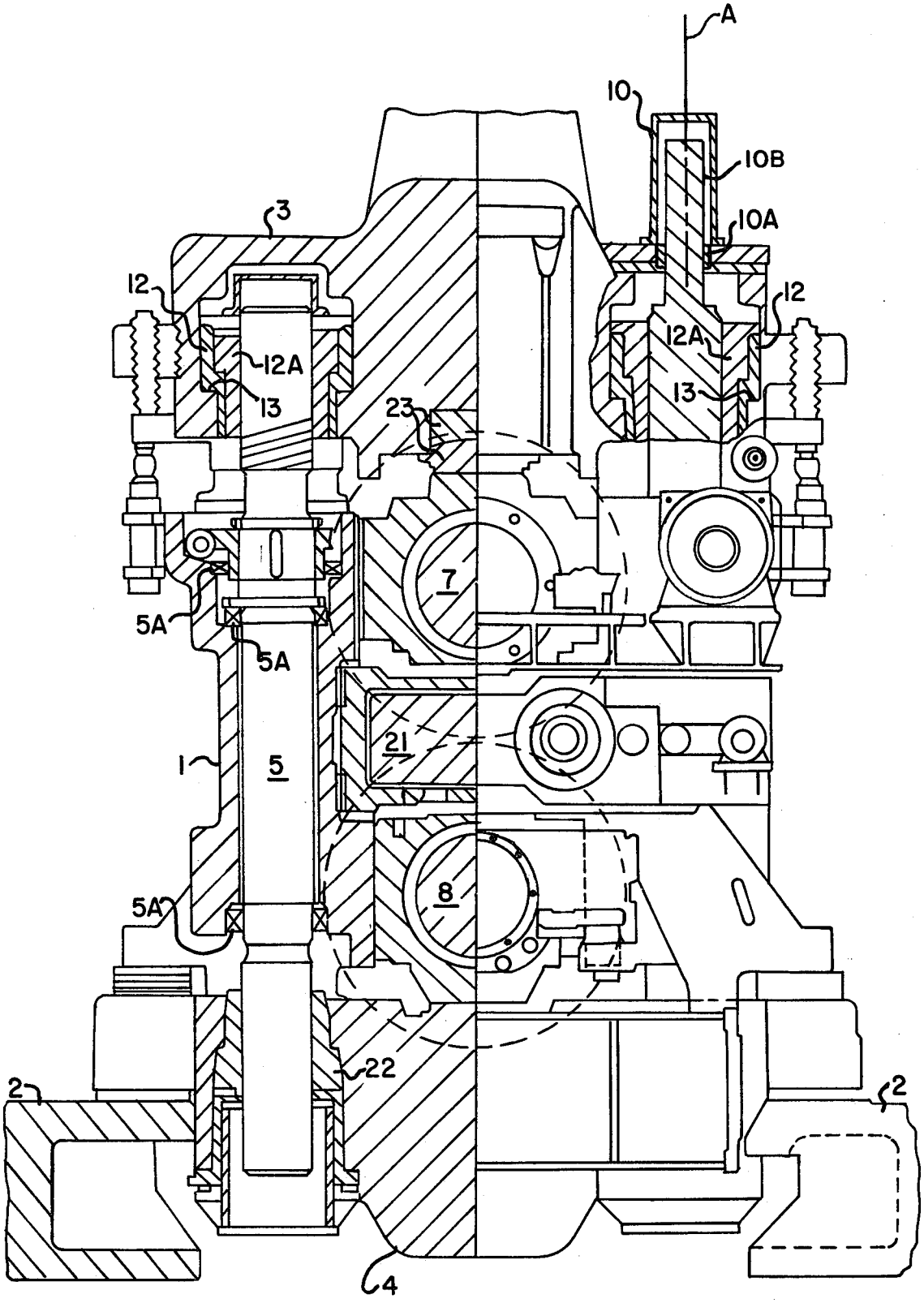

These features and advantages of the present invention as well as others will be more fully understood when the following description is read in light of the accompanying drawings, in which:

FIG. 1 is an isometric view of one embodiment of the present invention illustrating a universal rolling mill with one of two upper crossheads shown in a swung-out position and the other crosshead in the closed or swung-in position; and FIG. 2 is an elevational view, partly in section, from the operator's side of the rolling mill as shown in FIG. 1.

In FIGS. 1 and 2, reference numeral 1 denotes a massive housing frame which is mounted on bed plates 2. Upper and lower horizontal rolls 7 and 8, respectively, form part of roll assemblies that include bearing chocks mounted on the journals at opposite ends of the rolls and supported in windows of the frame 1. The rotational axes of rolls 7 and 8 lie within a common vertical plane which also contains the rotational axes of vertical rolls, one of which is shown in FIG. 2 and identified by reference numeral 21. The vertical rolls are supported by bearing chocks that are, in turn, received in windows of the housing frame 1. A pair of upper crossheads 3 and a pair of lower crossheads 4 are symmetrically disposed with respect to the passline for workpieces in the mill at each side thereof and interconnected by screwdown spindles 5. A pair of screwdown spindles interconnects one upper crosshead 3 with one lower crosshead 4. The spindles are received in vertical openings in the frame 1 where they are supported for rotation by bearings 5A. Each of the upper crossheads can be swung about a swivel axis A substantially corresponding to the rotational axis of one of the two spindles coupled thereto. A hydraulically-actuated piston and cylinder assembly 9 is connected at its cylinder end to one of the upper crossheads 3 and at its rod end to the other upper crosshead 3 to symmetrically swing the crossheads to opposite sides of the frame. Elongated supplementary bushings 10 carry bearing sleeves 10A on the tops of the crossheads 3 for support of the crossheads on an extended spindle part 10B (FIG. 2) Nut housings 12 each carries a nut member 12A to engage with a threaded end portion at the upper ends of the spindles. A nut member 22 engaged with a threaded end on the lower end of each spindle is supported in a recess in the lower crossheads. The nut housings 12 are supported in recessed openings in the crossheads 3. The nut housings 12 on the upper ends of the spindles 5 which do not form the swivel axes A are rigidly connected to each other by crossties 11. To facilitate release of a crosshead from support surfaces therein during swinging movement, the nuts 12A engaged with the spindles forming the swivel axes have threads with a pitch h which oppose the swinging movement. The swinging movement is indicated by a double-ended arrow in FIG. 1 and identified by B. The threads of the nuts produce a lifting of the crossheads brought about by the pitch of the threads engaged with the screwdown spindles.

A recess 14 is provided in each of the upper crossheads with dimensions which are slightly larger than the corresponding dimensions of the housing 12 for the adjusting nuts 12A to insure movement to and out of the recess during swinging movement of a crosshead. A contact surface 13 engages the bottom of the nut housing 12 for transmission of rolling forces which are imposed on the crossheads by supporting engagement with the bearing chocks for the horizontal rolls.

As shown in FIG. 2, rocker plates 23 are interposed between the crossheads and the horizontal roll chocks. In the operative position of the upper crossheads for rolling operation, the nut housings 12 are braced between the support frame 1 and the crosshead 3 by means of an actuator 16 typically in the form of a hydraulically-actuated piston and cylinder assembly. The crossheads 3 are also locked to the crosstie 11 by means of pins 17. As shown in FIG. 1, the top end face of the nut housing 12 is provided with a cover 18 to protect the end face from contamination when exposed by a pivotal or swinging movement of the crosshead. In the swung-out position, the projecting end portion of each crosshead is supported on pedestal blocks 19 having hydraulically-actuated piston and cylinder assemblies 20 to engage with the crosshead while the blocks are supported on frame 1. The pedestal blocks rest on the upper surface of projecting wing portions forming part of the housing frame 1. These wing portions carry screwdown spindles coupled by a drive 24 to a motor 25. The spindles have end portions that extend through window openings formed by the housing wing portions to engage with the chocks of the vertical rolls for adjusting the position thereof along the passline of the mill.

To carry out a roll-changing operation for the universal mill described above, the pins 17 are released from engagement with the crossties 11 and actuators 16 are operated to disengage from the upper crossheads. Thereafter, the hydraulic piston and cylinder assembly 9 is actuated to swing each of the crossheads 3 about swivel axis A. The recessed openings 14 in the upper crossheads are used for lateral movement of the crossheads which expose the nut housings 12 for two of the screwdown spindles. The upper crossheads are swung to position for support by the pedestal blocks 19. The top horizontal roll 7 together with its bearing chocks can then be removed from the mill stand. Thereafter, the vertical rolls and their chocks are moved one after the other to the center of the mill stand and removed. The bottom horizontal roll and its roll chocks are then removed from the mill stand. A replacement set of rolls can then be installed in the mill stand by following this procedure in reverse order. After the actual roll replacement procedure has been completed, the upper crossheads are swung about swivel axes A back into engagement with the exposed nut housings 12.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. A universal rolling mill comprising:

a pair of horizontal roll assemblies each including bearing chock assemblies for rotatable support thereof, a pair of vertical roll assemblies each including a bearing chock assembly for rotatable support thereof, a frame to carry said horizontal roll assemblies and said vertical roll assemblies with the rotational axis of each roll lying substantially within a common vertical plane which is generally perpendicular to a passline for a workpiece passed between said rolls, said frame including yoke sections for supporting said vertical roll assemblies, an adjustment spindle for each of said yoke sections to position said vertical roll assemblies in said frame, pairs of upper and lower crossheads for supporting said horizontal roll assemblies, spindles retained against axial displacement by said frame to rotate for adjustably positioning said crossheads relative to said frame, pivotal support means interconnecting one of said spindles engaged with each crosshead of the upper pair thereof, said pivotal support means including nut members having threads engaged with the spindle, said threads being constructed to elevate the crosshead during swinging movement of the crosshead to one side of said passline relative to said frame, nut assemblies including nut housings on each of said spindles to engage with one of the crossheads of the upper pair thereof, and tie means to interconnect said nut housings.

2. The universal rolling mill according to claim 1 wherein each of said pair of upper crossheads includes a disengageable support surface for said nut assemblies in the pivoted part of each crosshead.

3. The universal rolling mill according to claim 1 further including a piston and cylinder assembly means coupled between said upper crossheads for swinging each crosshead on said pivotal support means.

4. The universal rolling mill according to claim 1 further including means to engage said tie means for retaining said upper crossheads engaged with said nut assemblies.

5. The universal rolling mill according to claim 1 further including means to cover the upper part of said nut assemblies against contamination when exposed by swinging movement of said upper crossheads.

6. The universal rolling mill according to claim 1 further including means carried by said frame to support each of said upper crossheads when swung to one lateral side of said frame.

7. The universal rolling mill according to claim 6 wherein said means includes a hydraulically-displaced pedestal support.

* * * * *